US005455849A

United States Patent [19]

Logan et al.

[11] Patent Number: 5,455,849

[45] Date of Patent: Oct. 3, 1995

[54] AIR-CORE GRID FOR SCATTERED X-RAY REJECTION

[75] Inventors: Clinton M. Logan, Pleasanton; Stephen M. Lane, Oakland, both of Calif.

[73] Assignee: Regents of the University of California, Oakland, Calif.

[21] Appl. No.: 299,387

[22] Filed: Sep. 1, 1994

[51] Int. Cl.[6] ..... G21K 1/02

[52] U.S. Cl. ..... 378/154; 378/145; 378/149

[58] Field of Search ..... 378/145, 147, 378/149, 154; 250/505.1

[56] References Cited

U.S. PATENT DOCUMENTS 4,951,305 8/1990 Moore et al. ..... 378/154 X 5,263,075 11/1993 McGann et al. ..... 378/154 X

*Primary Examiner*—David P. Porta

*Attorney, Agent, or Firm*—Henry P. Sartorio; L. E. Carnahan

[57] ABSTRACT

The invention is directed to a grid used in x-ray imaging applications to block scattered radiation while allowing the desired imaging radiation to pass through, and to process for making the grid. The grid is composed of glass containing lead oxide, and eliminates the spacer material used in prior known grids, and is therefore, an air-core grid. The glass is arranged in a pattern so that a large fraction of the area is open allowing the imaging radiation to pass through. A small pore size is used and the grid has a thickness chosen to provide high scatter rejection. For example, the grid may be produced with a 200 μm pore size, 80% open area, and 4 mm thickness.

21 Claims, 1 Drawing Sheet

AIR-CORE GRID FOR SCATTERED X-RAY REJECTION

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention is directed to the imaging of objects with x-rays, particularly to grids utilized in the imaging apparatus to block scattered radiation, and more particularly to an air-core grid, and a process for fabricating same, using glass containing a high atomic number oxide, such as lead, constructed to provide a large fraction of the area open for allowing imaging radiation to pass through.

When imaging objects or parts of the human body, the quality of the image is compromised by scattered x-rays. Mechanical devices, called grids, are used to attempt to block the scattered radiation while allowing the desired imaging radiation to pass through. One common device for this purpose aligns foils of highly attenuating material, such as lead, such that the desired x-rays can pass between the foils while scattered x-rays are blocked because they arrive at different angles from the imaging radiation. To maintain alignment of the foils, a spacer material is used that is relatively transparent to the desired x-rays. This spacer material is usually paper, carbon, or aluminum.

Another prior grid arrangement involves vanes whose axes are parallel. A more recent approach, is a grid structure as described and claimed in copending application Ser. No. 08/051,228 filed Apr. 23, 1993, entitled "High Performance X-Ray Anti-Scatter Grid", and assigned to the same assignee. This grid arrangement involved a plurality of parallel or crossed slots formed in a substrate having low x-ray capacity and coated or filled with a material having high x-ray opacity whereby the scattered x-rays are blocked from entering the grid.

When imaging the human body with x-rays, such the chest area and imaging breasts for early detection of breast cancer, scattered radiation degrades the image. This is especially true when film is used to record or recapture the image for subsequent display on a light box. Film has an extremely limited dynamic range and the human eye/brain has a very limited ability to resolve differences in darkness in the image. The scattered radiation uses up a significant portion of the dynamic range of the film and reduces the contrast in the resulting image, making it more difficult or even impossible for the human eye to visualize disease, injury or abnormality. The scattered radiation also adds quantum noise to the image, thereby further degrading its diagnostic power.

While numerous prior approaches to solving the scattered radiation problem, including the use of various types of grids, as disccused above, a need still exists for a device which can allow the desired x-rays to pass through efficiently while blocking the undesired scattered x-rays. This is accomplished by the present invention which involves the formation of an air-core grid for scattered x-ray rejection. This is accomplished by using a grid composed of material such as glass containing lead oxide constructed in a pattern to block the scattered x-rays, with the desired imaging x-rays passing through open areas in the grid pattern, with grid being composed of about 80% open area. Thus, the grid of this invention also eliminates the prior used spacer material that is transparent to the desired x-rays.

SUMMARY OF THE INVENTION

It is an object of the present invention to provide a grid for an x-ray imaging apparatus.

A further object of the invention is to provide an air-core grid for scattered x-ray rejection, and to a process for fabricating same.

Another object of the invention is to provide a grid having a pattern containing x-ray rejection material and open area for passage of desired imaging x-rays.

Another object of the invention is to provide an air-core grid for scattered x-ray rejection using glass containing an oxide, element, or compound of high atomic number material, such as lead, with the grid having a high fraction of open area for the passage of desired imaging x-rays.

Other objects and advantages of the present invention will become apparent from the following description and accompanying drawing. The present invention involves a grid which allows the desired x-rays to pass through efficiently while blocking the undesirable scattered x-rays, and a process for fabricating the grid. It works on the principle that most of the scattered radiation enters the image receptor at an angle somewhat different from the original path. Therefore, grid structure (similar in concept to an old-fashioned ice cube tray divider) that has a high percentage of open area, but with walls that are highly attenuating for x-rays at the appropriate energy is an efficient geometry for this purpose. The material of construction of the grid walls of this invention is glass with a high content of lead oxide, or other high atomic number oxide. The lead provides for efficient attenuation of x-rays, and the high percentage (80% for example) of open area provides for unrestricted passage of the desired imaging x-rays. The grid of this invention is of an air-core type, eliminating the x-ray transparent material of the prior known grids. Thus, this grid has application in any system which uses x-rays to image objects, and functions for improving image quality, which is of particular importance in applications such as mammography. The process for fabricating the grid is generally similar to processes developed for producing fiber optic products.

BRIEF DESCRIPTION OF THE DRAWINGS

The accompanying drawings, which are incorporated into and form a part of the disclosure, illustrate an embodiment of the invention and, together with the description, serve to explain the principles of the invention.

DETAILED DESCRIPTION OF THE INVENTION

The present invention is directed to an air-core grid for scattered x-ray rejection and method for fabricating same. The grid of this invention allows desired radiation (x-rays) to pass therethrough efficiently while blocking undesired radiation (scattered x-rays), and works on the principle that most of the scattered radiation (x-rays) enters the image receptor at an angle somewhat different from the original path. Therefore, the grid structure of this invention (similar in concept to an old-fashioned ice cube tray divider) which has a high percentage (e.g. 80%) open area, but with walls that are highly attenuating for x-rays at an appropriate energy provides an efficient geometry for rejecting scattered x-rays.

More specifically, the invention involves a grid assembly with walls and a large percentage of open area (pore or separator spaces), and with air in the pores or separator spaces. The grid walls are formed of glass with a high content (5 to 50% by weight or other measure) of lead oxide, or an oxide of another element with a high atomic number, such as bismuth (Bi), tantalum (Ta), or uranium (U). The high atomic number material (lead) provides for efficient attenuation of x-rays. The method of fabricating the grid allows the thickness or depth of the grid walls to be many times the pore (open area) dimension. For example, a grid constructed to verify this invention has been produced with 200 μm pore or cross-section size, 80% open air (pores or separator spaces) a wall depth or thickness 4mm, and a wall width (distance between pores) of 20 μm. Thus, the ratio of grid wall thickness (depth) to pore size of this example is 20:1. Grids can be fabricated with a pore size (cross-section) of 20 to 800 μm, a wall depth of 1 to 20 mm, and a wall width of 5 to 800 μm, with an open air space of 50 to 90%, with a ratio of grid wall depth to pore size in the range of from 2:1 to 100:1. It is preferable that the open area be greater than 80% of the overall area of the grid.

Figure 1:
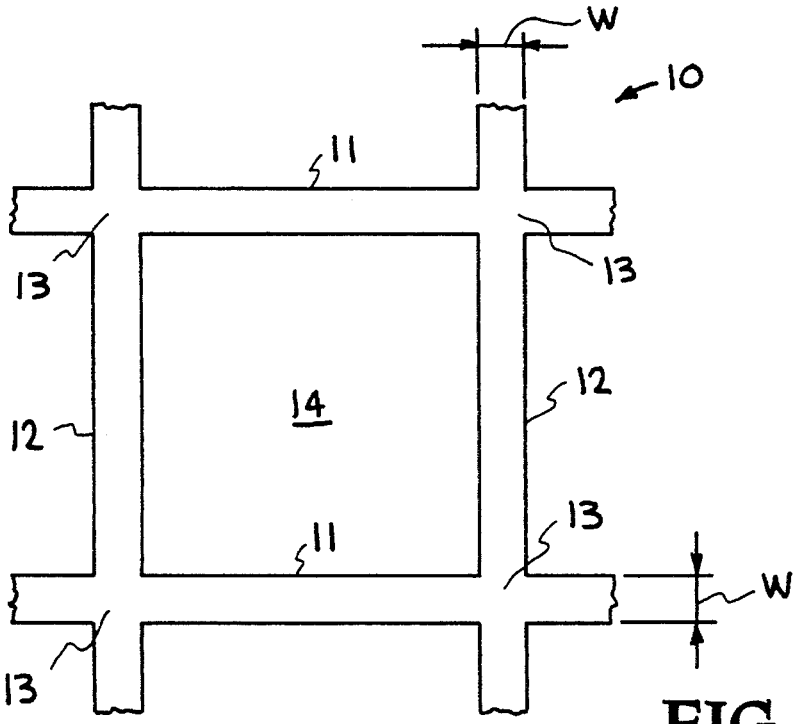
FIG. 1 is an enlarged plan view of a single segment of an embodiment of an air-core grid made in accordance with the present invention.

As shown in FIG. 1, a grid section, generally indicated at 10, is formed by two sets of perpendicular parallel walls 11—11 and 12—12 which intersect or cross at 13 to form an open space or pore 14 therebetween. Parallel walls 11—11 and 12—12 of the FIG. 1 embodiment are constructed of glass having a high content (5 to 50%) lead oxide, and a width, indicated at w, of 5 to 800 μm. The open space or pore 14 as shown in FIG. 1 is of a square configuration, with each side thereof being 200 μm, but may be of a different configuration (rectangle, triangle, annular, etc.).

Figure 2:
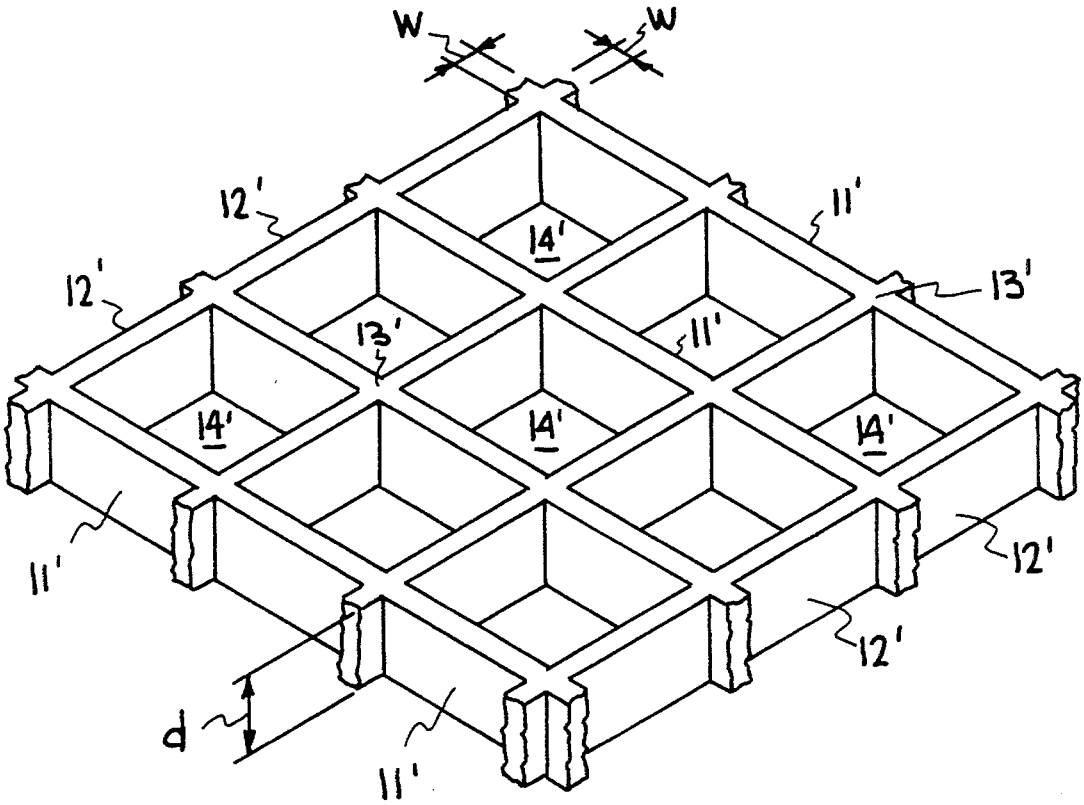
FIG. 2 is a partial prospective view of an air-core grid of the invention.

FIG. 2 illustrates a partial embodiment of a grid composed of a plurality of grid sections formed by parallel walls 11" and 12' interconnected at 13' which form pores or open spaces 14' (six illustrated.). Each of the walls 11' and 12' have a depth, indicated at d, of 4 mm and width w of 20 μm, and with pores 14' each having a square configuration with sides or cross-section of 200 μm, and providing an overall open area or air space of about 80%.

The air-core grid of this invention may be fabricated using methods generally similar to methods developed for producing fiber optic products. Basically, the method involves an array of square rods or members of etchable glass or other material forming a core material arranged in a leaded (high atomic number) glass matrix. After forming into a boule, the individual grid structures are sliced from the boule (to form a desired thickness or depth of the grid walls), and the core material (square rods of etchable glass) is etched away, leaving a leaded glass array composed of spaced interconnected walls 11'–12' forming pore or open areas 14, as illustrated in FIG. 2. An embodiment of the air-core grid utilized in experimental verification had a 200 μm pore size (cross-section), 80% open area, 4 mm wall depth, and 20 μm wall width.

While the air-core grid has been illustrated and described as a flat plane or sheet configuration, the grid can be configured so as to align the openings so that they all point to the x-ray source, thus forming a focused grid. This can be accomplished by bending the sheet into the shape of a sphere, such that the openings all point to the center of the sphere. This can be done by placing the sheet on a spherical mandrel and heating via a process called slumping.

It has thus been shown that the invention provides an air-core grid for scattered x-ray rejection having a large fraction of the area thereof open to allow passage therethrough of desired x-rays while efficiently blocking scattered x-rays, and to an effective method for fabricating the grid. The air-core grid has application in any device using x-rays to image objects and people, as is particularly applicable in x-ray imaging of the human body, especially the chest area and imaging of breasts for early detection of breast cancer.

While particular embodiments, materials, parameters, etc., of the grid, as well as a specific operational sequence, materials, temperatures, etchants, etc., for fabrication thereof, have been set forth to explain the principles of the invention, such are not intended to be limiting. Modifications and changes will become apparent to those skilled in the art, and it is intended that the invention be limited only by the scope of the appended claims.

We claim:

1. An air-core grid for scattered x-ray rejection, comprising:

a wall structure defining a plurality of open spaces therein, said open spaces having a cross-section of about 20 μm to about 800 μm;

said wall structure being configured to provide a fraction of an area thereof to be open for allowing passage therethrough of x-rays, said fraction of said area being 50 to 90%;

said wall structure being composed of glass containing a material of an atomic number capable of attenuating x-rays.

2. The air-core grid of claim 1, wherein said material is an oxide of the group consisting of lead, bismuth, tantalum, and uranium.

3. The air-core grid of claim 1, wherein said glass contains a quantity of said material in the range of 5 to 50%.

4. The air-core grid of claim 1, wherein said material is lead oxide.

5. The air-core grid of claim 1, wherein said fraction of said open area is greater than 80% of an overall area of said grid.

6. The air-core grid of claim 1, wherein said wall structure is composed of glass containing lead oxide, and wherein said open area is at least 80% of the overall area of the grid.

7. In an imaging apparatus utilizing radiation imaging, the improvement comprising:

a grid structure composed of a radiation attenuating material and constructed to provide about 50 to 90% open space for passage of radiation therethrough, said grid structure defining a plurality of open spaces therein having a cross-section of 20 to 800 μm.

8. The improvement of claim 7, wherein said radiation attenuating material include at least one element therein having an atomic number capable of attenuating x-rays.

9. The improvement of claim 8, wherein said radiation attenuating material is composed of glass containing said at least one element capable of attenuating x-rays.

10. The improvement of claim 8, wherein said material is a lead oxide containing glass.

11. The improvement of claim 9, wherein said at least one element capable of attenuating x-rays is selected from the group consisting of lead oxide, bismuth oxide, tantalum oxide, and uranium oxide.

12. The improvement of claim 9, wherein said radiation attenuating material is configured to form a plurality of walls defining said plurality of open spaces therebetween for the passage of radiation therethrough.

13. The improvement of claim 12, wherein said plurality of open spaces defined by said walls have a substantially square configuration.

14. The improvement of claim 13, wherein said plurality of open spaces have sides having a length of 20 to 800 μm, wherein said plurality of walls have a width of 5 to 800 μm, and a depth of 1 to 20 mm.

15. The improvement of claim 13, wherein said plurality of walls have a depth substantially greater than the cross-section of said plurality of open spaces.

16. The improvement of claim 7, wherein the grid structure is of a configuration selected from the group of flat sheet and spherical.

17. A method for forming an air-core grid for rejecting scattered x-rays in an x-ray imaging apparatus, comprising:

providing members composed of an etchable material;

arranging the members in a configuration in an x-ray attenuating material so as to form a boule;

slicing an individual grid structure from the boule; and etching away the etchable material of the individual grid structure, leaving an array of openings intermediate the x-ray attenuating material which define an open space of about 50 to 90% of the grid structure.

18. The method of claim 17, additionally including utilizing members composed of an etchable material which have a 20 to 800 μm cross-section of the array of openings formed intermediate the x-ray attenuating material.

19. The method of claim 17, wherein the members are composed of an etchable glass, and wherein the x-ray attenuating material is composed of glass having an x-ray attenuating element therein.

20. The method of claim 19, wherein the x-ray attenuating element is selected from lead, bismuth, tantalum, and uranium.

21. The method of claim 17, additionally including forming the x-ray attenuating material from glass having lead oxide therein.

* * * * *